US006053772A

United States Patent [19]

Aizawa et al.

[11] Patent Number: 6,053,772

[45] Date of Patent: Apr. 25, 2000

[54] NARROW PITCH MULTIPLE BOARD CONNECTOR ASSEMBLY AND SHIELD SHELL CONNECTING FITTING USED FOR THE SAME

[75] Inventors: Hidenori Aizawa; Yuji Hirai, both of Tokyo, Japan

[73] Assignee: Honda Tsushin Kogyo Co., Ltd., Tokyo, Japan

[21] Appl. No.: 09/178,001

[22] Filed: Oct. 21, 1998

[30] Foreign Application Priority Data

Nov. 8, 1998 [JP] Japan ..... 10-227288

[51] Int. Cl.[7] ..... H01R 13/648

[52] U.S. Cl. ..... 439/607; 439/353

[58] Field of Search ..... 439/607, 609, 439/353, 357

[56] References Cited

U.S. PATENT DOCUMENTS 5,557,507 9/1996 Koike et al. ..... 439/607

*Primary Examiner*—Michael L. Gellner
*Assistant Examiner*—Antoine Ngandjui
*Attorney, Agent, or Firm*—Leighton K. Chong

[57] ABSTRACT

The object of the invention is to provide a multiple board connector assembly which can be mounted on an electrically conductive panel without any necessity to provide the panel with a cross bar and is capable of enhancing the shield characteristics by electrically connecting upper and lower connectors and is of preventing external foreign matter from entering into contact pin area. A narrow pitch multiple board connector assembly including at least two board connectors which are stacked at a narrow pitch in a parallel manner with each other, each board connector having a contact housing which is surrounded by a shield shell made of a metal, each board connector being detachably connected with cable connector, said assembly is characterized in that a shield shell connecting fitting is adapted into a space between said two board connectors for filling the space with the fitting and for electrically connecting said board connectors with each other.

5 Claims, 5 Drawing Sheets

NARROW PITCH MULTIPLE BOARD CONNECTOR ASSEMBLY AND SHIELD SHELL CONNECTING FITTING USED FOR THE SAME

BACKGROUND OF THE INVENTION

The present invention relates to a narrow pitch multiple board connector assembly in which at least two board connectors are stacked at a narrow pitch in a parallel manner with each other and a shield shell connecting fitting used for the same.

RELATED ART

Connection between a plurality of electronic devices, for example between a computer and its peripheral devices has been accomplished by adapting a cable connector mounted on the end of a shielded cable to a board connector which is in turn connected to printed circuit boards of the computer or peripheral devices for establishing electric connection therebetween.

The shielded cable comprises a plurality of conductors and a shielding material such as, a braid or aluminum foil tape which surrounds the conductors. The cable is shielded so that the conductors are not adversely influenced by external electromagnetic waves, or conversely the electromagnetic waves are not externally leaked therefrom.

Similarly, the electronic devices are shielded so that its boards on which electronic components are disposed do not externally radiate the electromagnetic waves, or they are not adversely influenced by the electromagnetic waves radiated from the outside.

As the performance of the computers and their peripheral devices has advanced, multiple board connector assembly in which two or more board connectors are stacked in an elevational direction have recently been used instead of a single board connector.

FIG. 4 is a perspective view showing a prior art stacked type board connector assembly 20 which is mounted on an electrically conductive panel 25 and a cable connector 23 which is detachably connected to the board connector assembly 20.

The multiple board connector assembly 20 as shown in FIG. 4 is a double stacked type board connector assembly comprising upper and lower connectors 21 and 22. The upper and lower connectors 22 and 23 comprise electrically insulating contact housings 21*c* and 22*c*, a plurality of contacts 21*a* and 22*a* disposed in the housing and shield shells 21*b* and 22*b* which surround the periphery of the contact housings 21*c* and 22*c*, respectively.

Retaining members 21*d* and 22*d* are provided for engaging the cable connectors 23 which are connected to the upper and lower connectors 21 and 22 to prevent the cable connectors 23 from being removed from the connectors 21 and 22, respectively.

On the other hand, the shielded cable 24 includes a plurality of conductors and shielding materials (not shown) such as a braid (or shield mesh) and aluminum foil tape, which surround the conductors, and is connected to the cable connector 23.

The cable connector 23 is provided with an electrically conductive shield shell 23*b* which surrounds arrayed contact pins (not shown) and is also provided with knobs 23*a*, 23*a* for detachably engaging the retaining members (not shown) with retaining members 21*d* and 22*d* which are provided on the upper and lower connectors 21 and 22, respectively.

When the cable connectors 23 are adapted into the upper and lower connectors 21 and 22 of the multiple board connector assembly 20, the former connector 23 is electrically connected to the latter connectors 21 and 22 and an exposed front end of the shield shell 23*b* of the cable connector 23 is mechanically and electrically connected to the shield shells 21*b* and 22*b* so that the electromagnetic waves which are picked up by the shield cable 24 is by-passed to the ground via the electrically conductive shield shell 23*b*, the shield shells 21*b* and 22*b* of the upper and lower connectors 21 and 22, the electrically conductive panel 25 and electrically conductive screws 26, 26.

The above-mentioned prior art multiple board connector assembly 20 is mounted on the electrically conductive panel 25 by adapting the upper and lower connectors 21 and 22 into the two panel mount holes 28*a* and 28*b* formed in the panel 25, respectively, as shown in FIG. 5.

A portion of the electrically conductive panel 25 between two panel mount holes 28*a* and 28*b* (hatched in FIGS. 5(*a*) and 5(*b*)) is referred to as cross bar 25*a* and is deemed to be necessary for shielding a space between the upper and lower connectors 21 and 22 to protect the electronic device against the influence of electromagnetic waves and for preventing foreign matter from entering the inside of the multiple board connector assembly 20 from the outside thereof.

However, as the computers and their peripheral devices have become more compact in size, more miniaturization and higher density mounting of the connectors has been demanded. Accordingly, the spacing between the upper and lower connectors of the multiple board connector assembly has become gradually narrow and narrow pitch trend is proceeding. In order to mount a miniaturized and narrow pitch multiple board connector assembly on an electrically conductive panel, the cross bar should be made narrower correspondingly to narrow pitch. It is very hard to provide a cross bar having a narrow width on the electrically conductive panel in view of fabrication and rigidity.

If the upper and lower connectors are mounted on the panel with both connectors being in close contact with each other without leaving any space between the upper and lower connectors, the shield shell 23*b* of the cable connector 23 could not be adapted to the shield shells 21*b* and 22*b*. A space having such width that the shield shell 23*b* can be adapted is necessary between the upper and lower connectors.

However, leaving the space as it is may cause problems that the shield characteristics become worse and invasion of foreign matters is allowed.

Furthermore, prior art multiple board connector assembly 20 has the risk of shortening between contact pins 27 due to adhesion of foreign matters since the contact pins projecting rearwardly from the contact housings 21*c* and 22*c* are exposed.

SUMMARY OF THE INVENTION

It is therefore an object of the present invention to provide a miniaturized narrow pitch multiple board connector assembly which can be mounted on an electrically conductive panel without necessity of providing a cross bar and is capable of electrically connecting an upper shield shell with a lower shield shell to enhance the shield characteristics and of preventing foreign matters from entering the inside of the contact pins from the outside.

The invention as defined in claim 1 for accomplishing above mentioned object resides in a narrow pitch multiple board connector assembly including at least two board connectors which are stacked at a narrow pitch in a parallel manner with each other, each board connector having a contact housing which is surrounded by a shield shell made of a metal, each board connector being detachably connected with cable connector, said assembly being characterized in that a shield shell connecting fitting is adapted into a space between said two board connectors for filling the space with the fitting and for electrically connecting said board connectors with each other.

The invention as defined in claim 2 for accomplishing the above-mentioned object resides in a narrow pitch multiple board connector assembly as defined in claim 1, being characterized in that a cover which overlays a plurality of contact pins projecting rearward from said contact housing and being bent at right angles is mounted on said contact housing for preventing foreign matter from entering into the contact pin area.

The invention as defined in claim 3 for accomplishing the above-mentioned object resides in a shield shell connecting fitting for a narrow pitch multiple board connector assembly including at least two board connectors which are stacked at a narrow pitch in a parallel manner with each other, each board connector having a contact housing which is surrounded by a shield shell made of a metal, each board connector being detachably connected with cable connector, said fitting being characterized in that it includes a metallic having an electric conductivity and in that it is adapted into the space between said two board connectors for filling the space therewith and is provided with contact pieces which are brought into contact with said parallel two shield shells.

The invention as defined in claim 4 for accomplishing the above-mentioned object resides in a shield shell connecting fitting as defined in claim 3 characterized in that said metallic member is made of stainless steel and is formed by press working so that it has a cross-section of substantially inverted U-shape.

The invention as defined in claim 5 for accomplishing the above-mentioned object resides in a shield shell connecting fitting as defined in claim 3 or 4 characterized in that said shield shell connecting fitting is also provided with retaining pieces for preventing the fitting from being removed from the contact housing.

BEST MODES FOR EMBODYING THE PRESENT INVENTION

Now, a preferred embodiment of a narrow pitch multiple board connector assembly of the present invention and a shield shell connecting fitting used for the same will be described with reference to the drawings.

Figure 1:
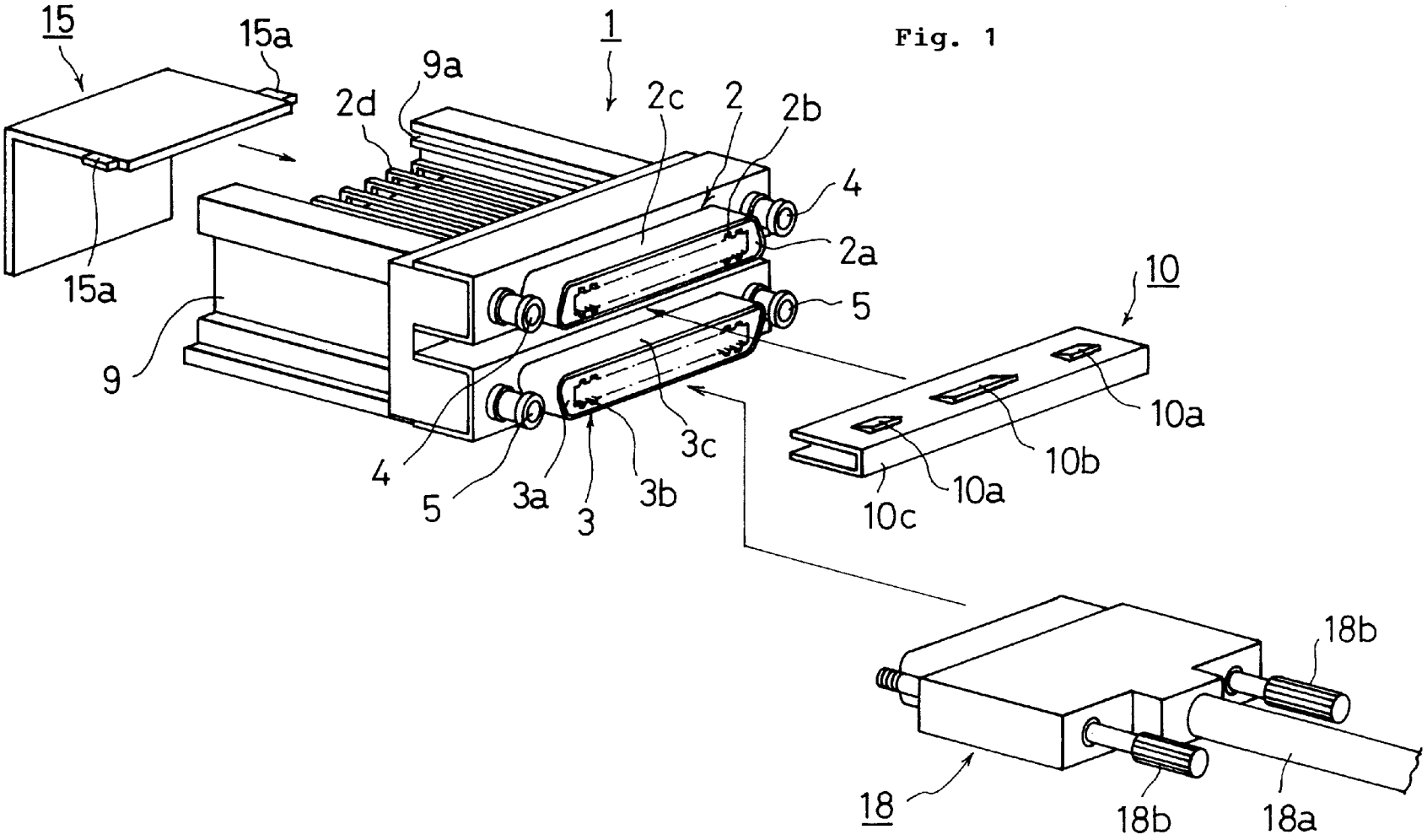
FIG. 1 is a perspective view showing an embodiment of a narrow pitch multiple board connector assembly of the present invention and a shield shell connecting fitting used for the same.
Figure 2A:
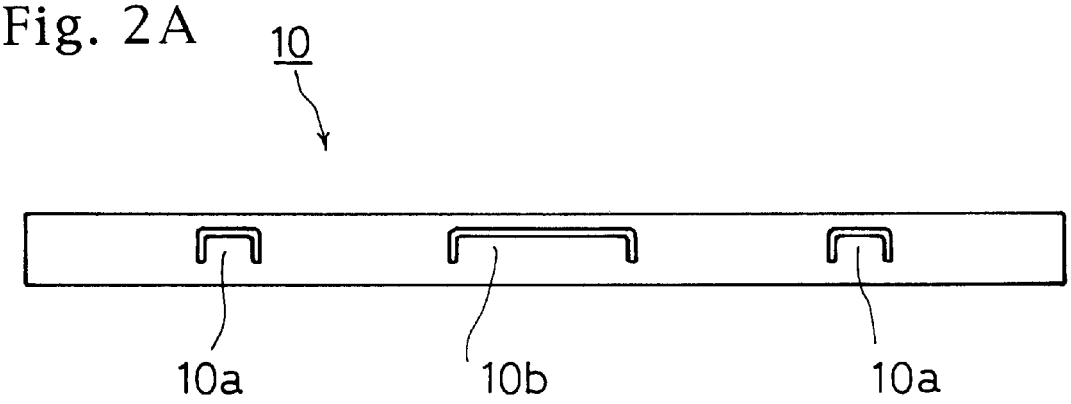
FIG. 2A and FIG. 2B are plan views showing a shield shell connecting fitting of the present invention and a longitudinal sectional view showing the shield shell connecting fitting, respectively.
Figure 2B:
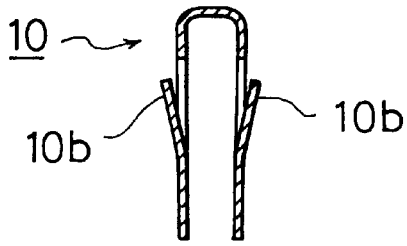

FIG. 1 is a perspective view showing an embodiment of the narrow pitch multiple board connector assembly of the present invention and the shield shell connecting fitting used for the same.

The narrow pitch multiple board connector assembly 1 comprises an integral electrically insulating frame 9 having two connectors such as upper and lower connectors 2 and 3. The electrically insulating frame 9 in the embodiment is made of a resin material having electrically insulating characteristics. There is provided a pitch of about 5 mm between the upper and lower connectors 2 and 3.

The upper and lower connectors 2 and 3 comprises contact housings 2*a* and 3*a* made of resin and shield shells 2*c* and 3*c* made of a metal having an electrical conductivity, which surround the periphery of the housings, respectively. The contact housings 2*a* and 3*a* are provided with a plurality of electrically conductive contacts 2*b* and 3*b*, respectively, to which cable connectors 18 are electrically connected when the cable connectors 18 are adapted into the housings.

A plurality of contact pins 2*d* project from the corresponding contacts 2*b* and 3*b* on the side opposite to the side on which the cable connectors 18 are connected and then bent at right angles. The contact pins are electrically connected to printed circuit boards of a computer or other peripheral devices.

The upper and lower connectors 2 and 3 are provided on their right and left sides thereof with retaining members 4 and 5, respectively for preventing the connected cable connectors 18 from being removed.

Although the cable connectors 18 are firmly secured to the retaining members 4 and 5 by threadably engaging the screw 18*b* and 18*b* which are mounted on the cable connectors 18 into the retaining members 4 and 5, respectively, retaining means is not limited to only the illustrated one. For example, the retaining means may comprise retaining members 21*d* with which ratchet pawls (not shown) are engaged by means of knobs 23*a*.

There is provided a space of about 1 mm between the upper and lower connectors 2 and 3, to which a shield shell connecting fitting 10 is adapted.

The shield shell connecting fitting 10 is made of a metallic material having an electrical conductivity such as stainless steel and the like and has a cross section which is in the substantially -shape. The upper and lower sides of the shield shell connecting fitting 10 or the side with which the shield shells 2*c* and 3*c* of the upper and lower connectors 2 and 3 are in contact are provided with contact pieces 10*a* and 10*a*.

It can be devised that the shield shells 2*c* and 3*c* be integrally formed so that they are electrically connected with each other. However, fabrication of them would be very hard and the manufacturing cost would become prohibitively high since the connectors per se are compact and the space between me shield shells 2*c* and 3*c* is small. Accordingly, using the shield shell connecting fitting 10 according to the present invention is very advantageous.

The contact pieces 10*a*, 10*a* are formed by cutting part of the shield shell connecting fitting 10 into substantially inverted U-shape and erecting one edge of the cut out portions opposite to the adapting (or inserting) direction. When the shield shell connecting fitting 10 is adapted into the space between the upper and lower connectors 2 and 3, the contact pieces 10*a*, 10*a* are brought into contact with the shield shells 2*c* and 3*c*, respectively so that they are electrically connected to each other.

The shield shell connecting fitting 10 is provided on its upper and lower sides with retaining pieces 10*b* for preventing the fitting from being removed. The retaining pieces 10*b* are formed by cutting part of the shield shell connecting fitting 10 and erecting one edge of the cut out portion similarly to the contact pieces 10*a,* 10*a.*

When the shield shell connecting fitting 10 is completely adapted into the space between the upper and lower connectors 2 and 3, the retaining pieces 10*b* is engaged with engaging portions (not shown) formed on one side of the respective shield shell 2*c,* 3*c* to prevent the fitting from moving in an outward direction so that removal of the fitting is avoided.

The shield shell connecting fitting 10 is in the simple form and can be easily fabricated by press working.

Alternatively, the contact pieces 10*a,* 10*a* may not be provided separately from the retaining piece 10*b.* For example, the contact pieces 10*a,* 10*a* may perform both roles of electrical connection and removal prevention.

The shield shell connecting fitting 10 is not limited to the shape shown in the embodiments if it may have a shield portion 10*c* to fill the space between the upper and lower connectors 2 and 3 and contact means to contact with the shield shells 2*c* and 3*c* so that it is electrically connected therewith.

A cover 15 which overlays the plurality of contact pins 2*d* is mounted on the electrically insulating frame 9 for preventing foreign matters from entering the area of the contact pin 2*d* (contact pins extending from the lower connector 3 not shown) which project rearward from the contact housings 2*a,* 3*a* and then are bent at right angles.

The cover 15 is made of an electrically insulating resin material and is mounted on the electrically insulating frame 9 by forcedly adapting its right and left edges into the right and left slide grooves 9*a* and 9*a* formed on the electrically insulating frame 9. The cover 15 is provided with protuberances 15*a,* 15*a,* which are adapted to engage with recesses (not shown) formed on the electrically insulating frame 9 for preventing the cover 15 from being removed from the electrically insulating frame 9. The means for preventing the cover 15 from being removed from the electrically insulating frame 9 is not limited to the described and illustrated one, but may be protuberances 15*a,* 15*a* of the cover 15 which are forcedly adapted into the right and left slide grooves 9*a,* 9*a* for engagement therewith.

Figure 3A:
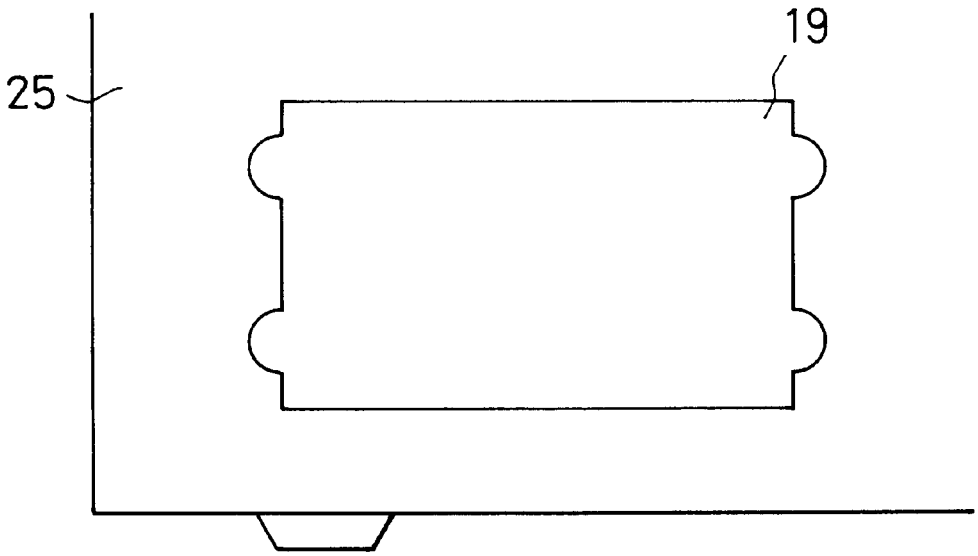
FIG. 3A and FIG. 3B are front views showing a panel mount hole for mounting the narrow pitch multiple board connector assembly in FIG. 1 and the narrow pitch multiple board connector assembly which has been mounted thereon, respectively.
Figure 3B:
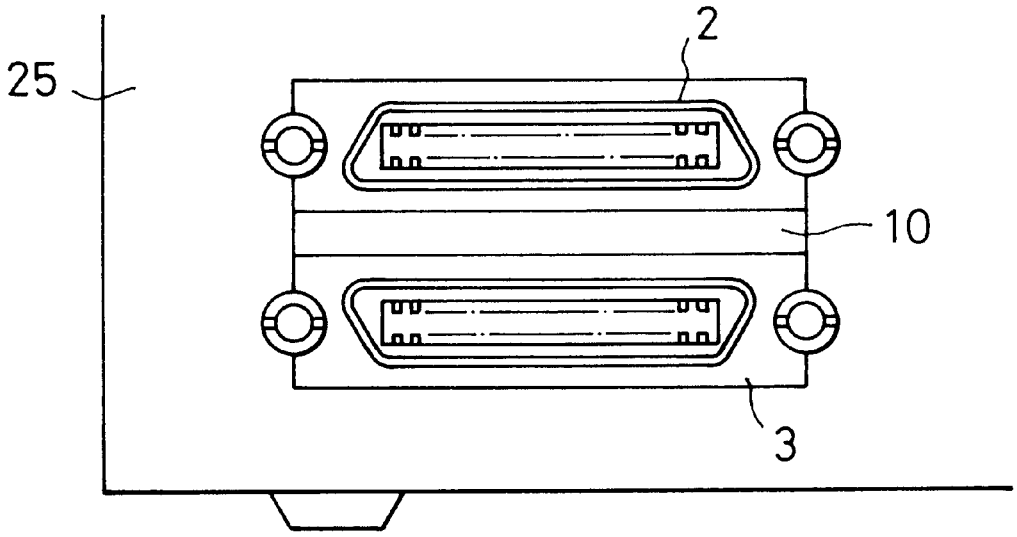
Figure 4:
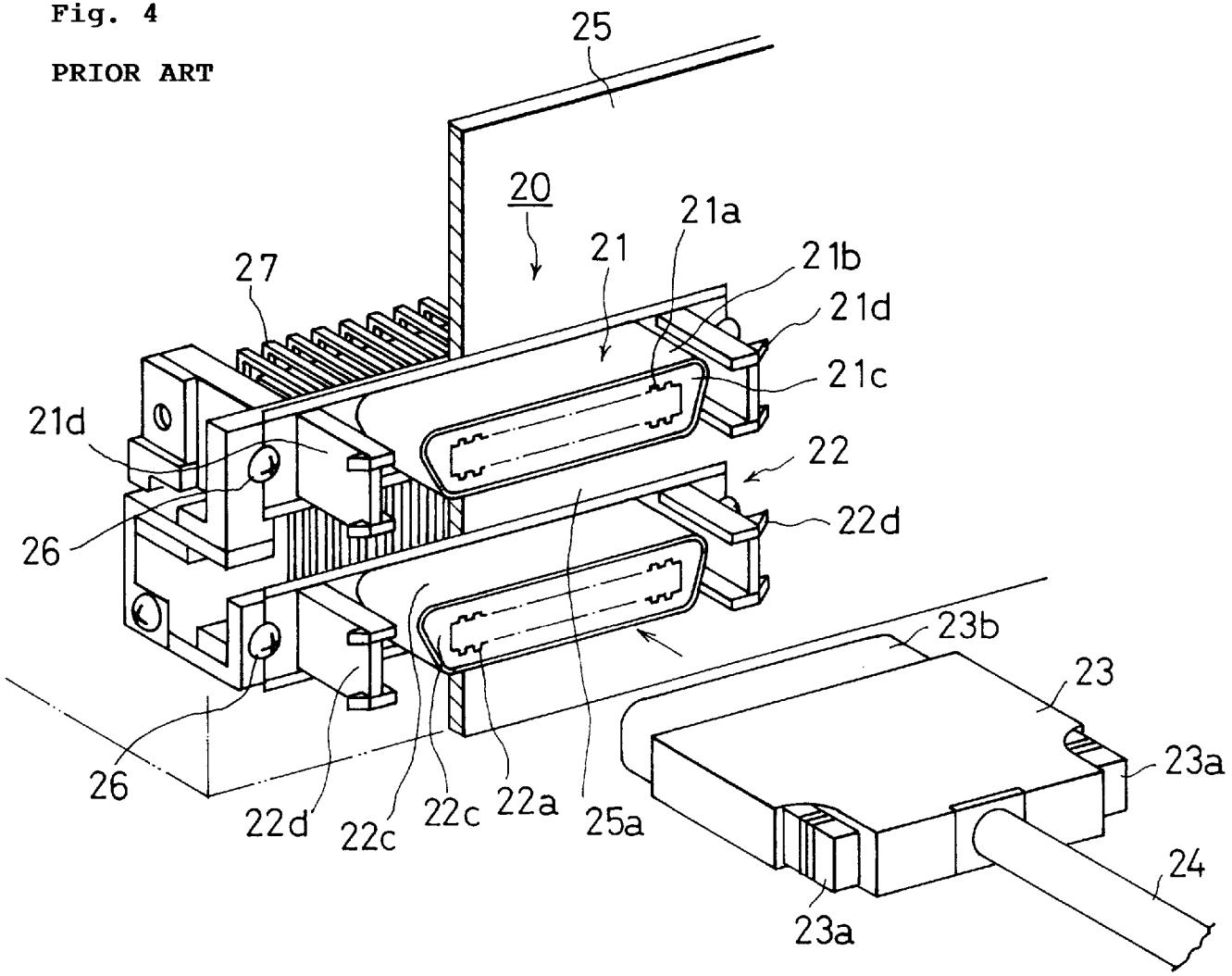
Fig. 4 PRIOR ART
FIG. 4 is a perspective view showing a prior art multiple board connector assembly and a cable connector.
Figure 5A:
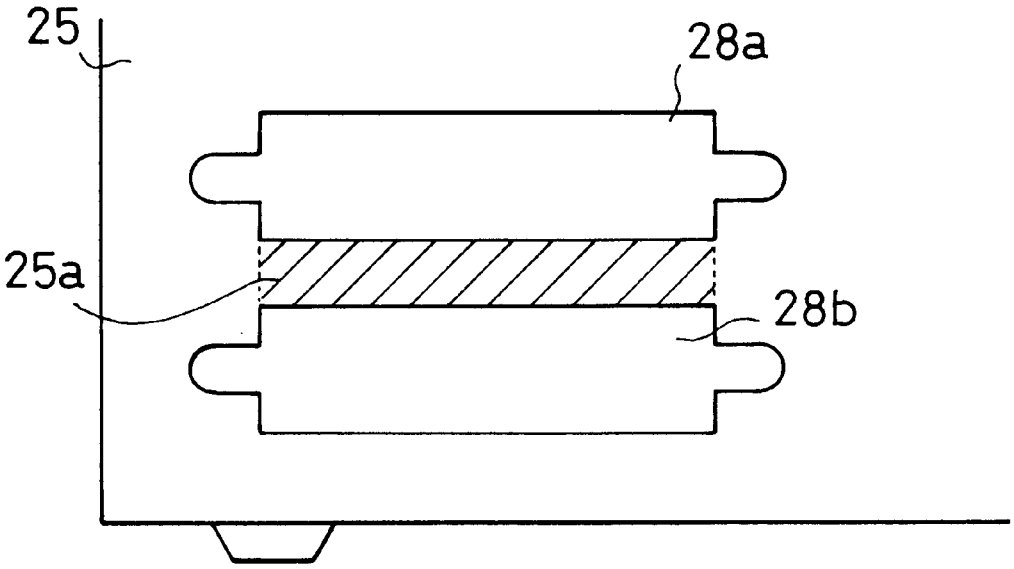
FIG. 5A and FIG. 5B are front views showing panel mount holes for mounting a prior art multiple board connector assembly and the prior art multiple board connector assembly which has been mounted thereon.
Figure 5B:
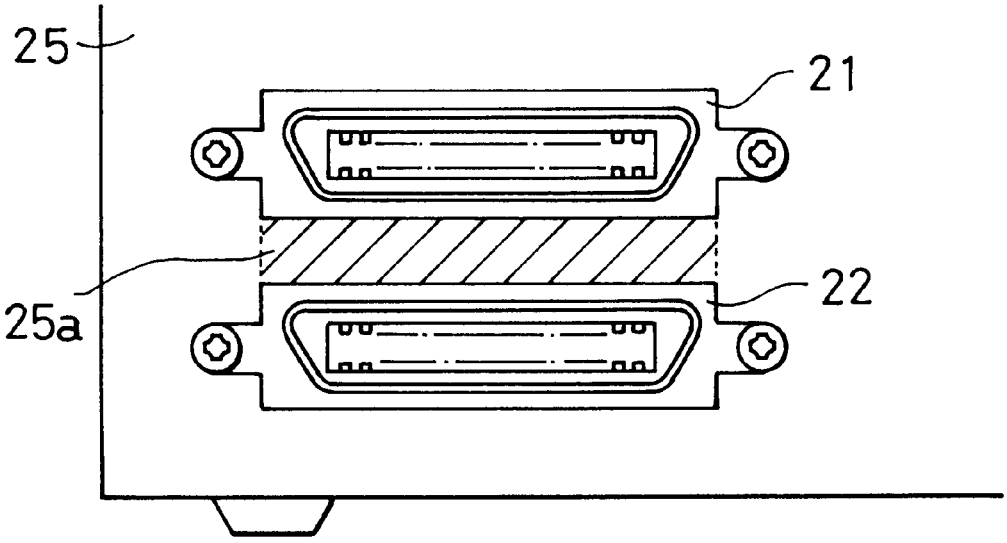

When the narrow pitch multiple board connector assembly 1 of the present invention is mounted on a computer or peripheral devices, provision of only one panel mounting hole 19 on the electrically conductive panel 25 as shown in FIG. 3(*a*) is required.

In the narrow pitch multiple board connector assembly 1 of the present invention which is mounted on the electrically conductive panel 25 as shown in FIG. 3(*b*), the shield shell connecting fitting 10 is adapted into the space between the upper and lower connectors 2 and 3 so that the upper and lower connectors 2 and 3 are electrically connected with each other. This connection causes the electromagnetic waves which are picked up by the shield cable 18*a* is by-passed to the ground via a shield path comprising electrically conductive shield shells 2*c,* 3*c,* retaining members 4 and 5 and electrically conductive panel 25.

As mentioned above, in the narrow pitch multiple board connector assembly of the present invention, only one panel mount hole is required to be provided on the electrically conductive panel for electronic equipment such as computer or peripheral devices. Necessity to provide two panel mount holes and a cross bar may be omitted unlike the prior art. An advantage is provided that fabrication of the electrically conductive panel becomes easier.

Furthermore, there is also provided an advantage that the risk of shortening of the contact pins due to entrance of foreign matters into the contact pin area can be reduced or eliminated since a cover which overlays the area of the plurality of contact pin projecting rearward from the contact housing and then being bent at right angles.

There is also provided an advantage that due to the fact that the shield shell connecting fitting of the present invention is provided with contact pieces and is adapted into the space between the upper and lower connectors of the narrow pitch multiple board connector assembly, electrical connection between the upper and lower connectors enables the shield characteristics to be enhanced and entrance of external foreign matters into the contact pin area to be avoided.

Since the shield shell connecting fitting can be easily fabricated by press working, it can be advantageously manufactured at a low cost.

What is claimed is:

1. A narrow pitch multiple board connector assembly including at least two board connectors which are stacked at a narrow pitch in a parallel manner with each other, each board connector having a contact housing which is surrounded by a shield shell made of a metal, each board connector being detachably connected with cable connector, said assembly being characterized in that a shield shell connecting fitting is adapted into a space between said two board connectors for filling the space with the fitting and for electrically connecting said board connectors with each other.

2. A narrow pitch multiple board connector assembly as defined in claim 1, being characterized in that a cover which overlays a plurality of contact pins projecting rearward from said contact housing and being bent at right angles is mounted on said contact housing for preventing foreign matter from entering into the contact pin area.

3. A shield shell connecting fitting for a narrow pitch multiple board connector assembly including at least two board connectors which are stacked at a narrow pitch in a parallel manner with each other, each board connector having a contact housing which is surrounded by a shield shell made of a metal, each board connector being detachably connected with cable connector, said fitting being characterized in that it includes a metallic member having an electric conductivity and in that it is adapted into the space between said two board connectors for filling the space therewith and is provided with contact pieces which are brought into contact with said parallel two shield shells.

4. A shield shell connecting fitting as defined in claim 3, being characterized in that said metallic member is made of stainless steel and is formed by press working so that it has a cross-section of inverted/U-shape.

5. A shield shell connecting fitting as defined in claim 3, being characterized in that said shield shell connecting fitting is also provided with retaining pieces for preventing the fitting from being removed from the contact housing.

* * * * *